US008833906B2

(12) United States Patent
Kemma et al.

(10) Patent No.: US 8,833,906 B2
(45) Date of Patent: Sep. 16, 2014

(54) IMAGE FORMING APPARATUS INCLUDING DROPLET-EJECTION RECORDING HEAD

(75) Inventors: Tsuguyori Kemma, Kanagawa (JP); Makoto Kikura, Kanagawa (JP); Norikazu Yanase, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 263 days.

(21) Appl. No.: 13/104,240

(22) Filed: May 10, 2011

(65) Prior Publication Data

US 2011/0279499 A1 Nov. 17, 2011

(30) Foreign Application Priority Data

May 11, 2010 (JP) ..... 2010-109703

(51) Int. Cl.
*B41J 2/14* (2006.01)

(52) U.S. Cl.
USPC ..... 347/50; 347/14; 347/9

(58) Field of Classification Search
USPC ..... 347/5, 9, 50, 37, 49, 14
IPC ..... B41J 11/22,19/00
See application file for complete search history.

(56) References Cited

U.S. PATENT DOCUMENTS

| | | | | |
|---|---|---|---|---|
| 4,750,881 | A | 6/1988 | Kikuchi et al. | |
| 6,375,297 | B1 * | 4/2002 | Hayashi et al. | 347/14 |
| 2005/0195242 | A1 | 9/2005 | Samoto et al. | |
| 2009/0174749 | A1 | 7/2009 | Kemma | |
| 2010/0026758 | A1 | 2/2010 | Tanaka et al. | |
| 2010/0067938 | A1 | 3/2010 | Kemma et al. | |
| 2010/0207990 | A1 | 8/2010 | Ito et al. | |

FOREIGN PATENT DOCUMENTS

| | | |
|---|---|---|
| CN | 1666880 | 9/2005 |
| EP | 1574349 A1 | 9/2005 |
| JP | 59-26285 | 2/1984 |
| JP | 59-59485 | 4/1984 |
| JP | 5-177829 | 7/1993 |
| JP | 7-81173 | 3/1995 |
| JP | 2001-171096 | 6/2001 |
| JP | 2002-240391 | 8/2002 |
| JP | 2004-82472 | 3/2004 |
| JP | 2005-81691 | 3/2005 |
| JP | 2005-169793 | 6/2005 |
| JP | 2005-199584 | 7/2005 |

(Continued)

OTHER PUBLICATIONS

Sep. 6, 2011 European search report in connection with counterpart european patent application No. 11 16 5325.

(Continued)

*Primary Examiner* — Lam S Nguyen
(74) *Attorney, Agent, or Firm* — Cooper & Dunham LLP

(57) ABSTRACT

An image forming apparatus includes a carriage reciprocally movable in a main scanning direction in the image forming apparatus; a recording head mounted on the carriage to eject droplets; a carriage circuit board mounted on the carriage and equipped with a circuit; a control circuit board provided in the image forming apparatus and equipped with a control circuit; a board mount provided in the carriage on which the carriage circuit board is horizontally disposed; and a flexible flat cable connecting the control circuit board and the carriage circuit board and movable in the main scanning direction below the board mount. The flexible flat cable is extended below the carriage circuit board, bent back toward the carriage circuit board, and connected to the carriage circuit board from the main scanning direction.

13 Claims, 6 Drawing Sheets

(56) References Cited

FOREIGN PATENT DOCUMENTS

| | | |
|---|---|---|
| JP | 3845122 | 8/2006 |
| JP | 2006-231820 | 9/2006 |
| JP | 2007-111865 | 5/2007 |
| JP | 2009-978 | 1/2009 |

OTHER PUBLICATIONS

Chinese official action dated Jul. 2, 2013 in corresponding Chinese patent application No. 2011 10 13 4095.2.
Japanese official action dated Oct. 22, 2013 in corresponding Japanese patent application No. 2010-109703.

* cited by examiner

IMAGE FORMING APPARATUS INCLUDING DROPLET-EJECTION RECORDING HEAD

CROSS-REFERENCE TO RELATED APPLICATIONS

The present patent application claims priority pursuant to 35 U.S.C. §119 from Japanese Patent Application No. 2010-109703, filed on May 11, 2010 in the Japan Patent Office, which is hereby incorporated herein by reference in its entirety.

BACKGROUND

1. Field

Exemplary embodiments of the present disclosure relate to an image forming apparatus, and more specifically to an image forming apparatus including a recording head that ejects liquid droplets.

2. Description of the Background Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head having a liquid ejection head (liquid-droplet ejection head) for ejecting droplets of ink.

Such liquid-ejection-type image forming apparatuses fall into two main types: a serial-type image forming apparatus that forms an image by ejecting droplets from the recording head while moving the recording head in a main scanning direction of the carriage, and a line-head-type image forming apparatus that forms an image by ejecting droplets from a linear-shaped recording head held stationary in the image forming apparatus.

In the serial-type image forming apparatus, a carriage may mount a recording head and a carriage circuit board, e.g., a relay board to relay between a driving circuit to drive the recording head and a control circuit board implemented as a control circuit to control the entire image forming apparatus. The control circuit board and the carriage circuit board are connected via, e.g., a flexible flat cable (FFC), and the carriage circuit board and the recording head are connected via, e.g., an FFC equipped with a driving circuit.

In such a case, the carriage circuit board is vertically disposed along the back face of the carriage, and the flexible flat cable is also vertically extended along the flat face of the carriage circuit board, that is, the flat face of the flexible flat cable is vertically disposed.

However, in the above-described configuration, when the flexible flat cable is installed in the image forming apparatus, the flexible flat cable is not accessible from the upper side of the image forming apparatus. Such a configuration makes it difficult to install the flexible flat cable to connect the recording head and the carriage circuit board, thus hindering smooth installation.

In addition, in maintenance work, such as removal of the flexible flat cable from the carriage circuit board and cleaning of an encoder sensor on the carriage circuit board, an operator cannot easily access the carriage circuit board and the encoder sensor, thus hindering smooth maintenance work.

At the back side of the carriage is also provided a metal sheet member, e.g., a rear stay forming part of a frame of the image forming apparatus. While face-to-face contacting the sheet metal, the flexible flat cable is guided and deformed in accordance with movement of the carriage. However, contacting the flexible flat cable and the sheet metal over a relatively large area tends to cause noise in the flexible flat cable.

SUMMARY

In an aspect of this disclosure, there is provided an improved image forming apparatus including a carriage, a recording head, a carriage circuit board, a control circuit board, a board mount, and a flexible flat cable. The carriage is reciprocally movable in a main scanning direction in the image forming apparatus. The recording head is mounted on the carriage to eject droplets. The carriage circuit board is mounted on the carriage and equipped with a circuit. The control circuit board is provided in the image forming apparatus and equipped with a control circuit. The board mount is provided in the carriage on which the carriage circuit board is horizontally disposed. The flexible flat cable connects the control circuit board and the carriage circuit board and is movable in the main scanning direction below the board mount. The flexible flat cable is extended below the carriage circuit board, bent back toward the carriage circuit board, and connected to the carriage circuit board from the main scanning direction.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
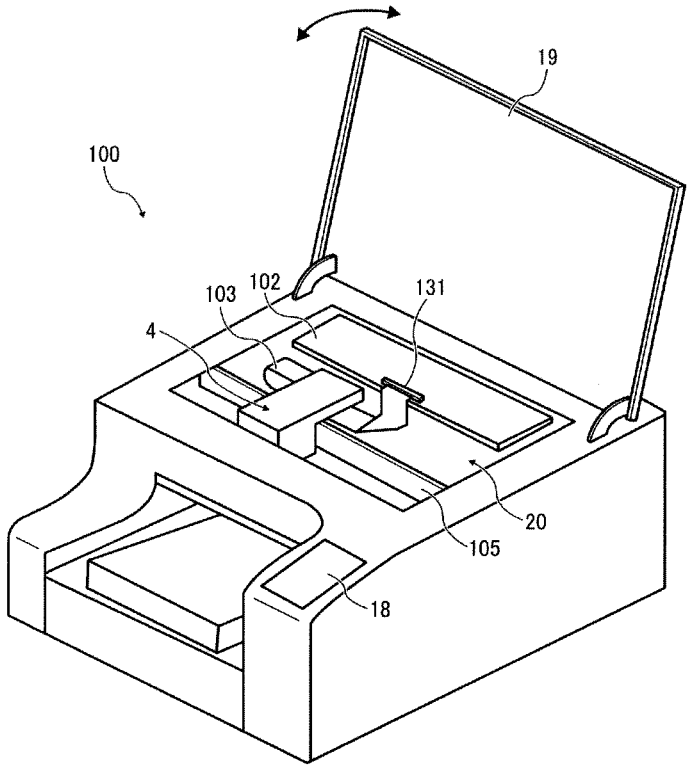
FIG. 1 is a schematic perspective view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium. The term "ink" used herein is not limited to "ink" in a narrow sense and includes anything useable for image formation, such as a DNA sample, resist, pattern material, washing fluid, storing solution, and fixing solution. The term "image" used herein is not limited to a two-dimensional image and includes, for example, an image applied to a three dimensional object and a three dimensional object itself formed as a three-dimensionally molded image. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, or a recording sheet.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

Figure 5:
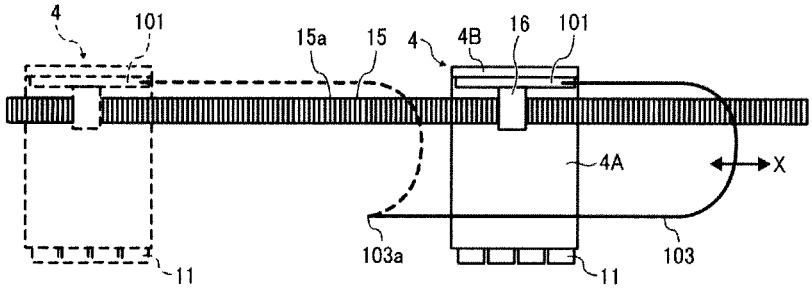
FIG. 5 is a back view of the carriage illustrated in FIG. 4.

First, an image forming apparatus according to an exemplary embodiment of the present disclosure is described with reference to FIGS. 1 and 5.

Figure 2:
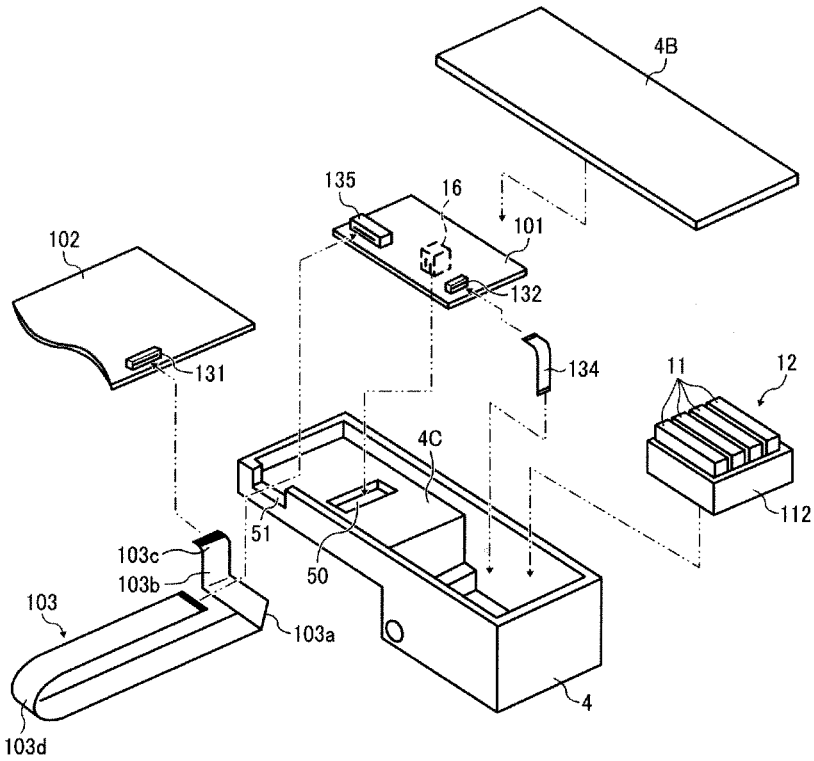
FIG. 2 is an exploded perspective view of a mechanical section of the image forming apparatus illustrated in FIG. 1.
Figure 3:
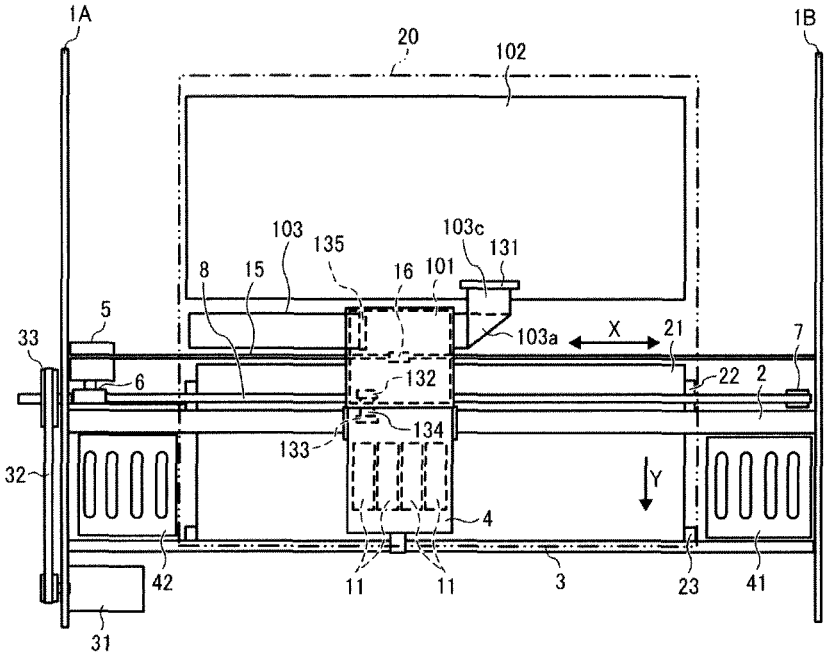
FIG. 3 is a plan view of the mechanical section illustrated in FIG. 2.
Figure 4:
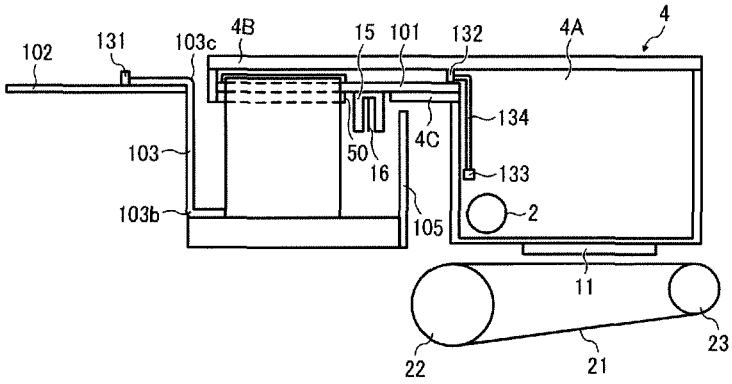
FIG. 4 is a side view of a carriage and surrounding components of the mechanical section.

FIG. 1 is a perspective view of the image forming apparatus 100. FIG. 2 is an exploded view of a portion of a mechanical section of the image forming apparatus 100. FIG. 3 is a plan view of the mechanical section. FIG. 4 is a side view of a carriage section. FIG. 5 is a back view of the carriage section.

The image forming apparatus 100 is a serial-type image forming apparatus and has a cover 19 openable/closable at an upper side thereof. By opening the cover 19, an opening 20 is opened so that an operator can access the mechanical section inside the image forming apparatus 100.

The mechanical section includes a main left-side plate 1A, a main right-side plate 1B, a main guide rod 2, a sub guide rod 3, a carriage 4, a main scan motor 5, a driving pulley 6, a driven pulley 7, and a timing belt 8. The main guide rod 2 and the sub guide rod 3 serving as guide members extend between the main side plates 1A and 1B and 100R to support the carriage 4. The carriage 4 supported on the main guide rod 1 and the sub guide member is slidable in a main scanning direction indicated by a double arrow X in FIG. 3. The carriage 4 is moved for scanning in the main scanning direction X by the main scan motor 5 via the timing belt 8 extended between the driving pulley 6 and the driven pulley 7.

On the carriage 4 are mounted a plurality of recording head units 11 including liquid ejection heads serving as image forming devices to eject ink droplets of, for example, yellow (y), cyan (c), magenta (m), and black (k), respectively, and head tanks to supply ink to the liquid ejection heads. The recording head units 11 are mounted on the carriage 3 so that multiple nozzle rows each including a plurality of nozzle orifices are arranged parallel to a sub scanning direction (indicated by an arrow Y illustrated in FIG. 3) perpendicular to the main scanning direction X and ink droplets are ejected downward from the nozzle orifices. The plurality of recording head units 11 is held by a head holder 112 to form a head assembly 12 as a single unit and mounted on a head mount 4A of the carriage 4.

An encoder scale 15 is disposed along the main scanning direction X of the carriage 4. On the carriage 4 is mounted an encoder sensor 16 serving as a transmissive photosensor to read a scale (scale index serving as position identifier) 15*a* of the encoder scale 15. The encoder scale 15 and the encoder sensor 16 form a linear encoder serving as a position detector to detect the position of the carriage 4.

Below the carriage 4 is provided a conveyance belt serving as a conveyance unit to convey a sheet in the sub scanning direction Y. The conveyance belt 21 is an endless belt looped around a conveyance roller 22 and a tension roller 23. The conveyance roller 22 is rotated by a sub-scanning motor 31 via a timing belt 32 and a timing pulley 33. The rotation of the conveyance roller 22 causes the conveyance belt 21 to circulate in the sub-scanning direction Y.

At one end in the main scanning direction X of the carriage 4, a maintenance unit 41 is disposed near one lateral side of the conveyance belt 21 to maintain and recover nozzle conditions of the liquid ejection heads of the recording head units 11. At the other end, a liquid receptacle 42 is disposed near the other lateral side of the conveyance belt 21 to receive ink droplets ejected for maintenance. The maintenance unit 41 includes, for example, cap members, a wiping member, and a second liquid receptacle. Each of the cap members caps a nozzle face (i.e., a face in which nozzle orifices are formed) of the corresponding one of the recording head units 11. The wiping member wipes the nozzle faces of the recording head units 11. The second liquid receptacle receives droplets not used for image formation.

The image forming apparatus 100 further includes, for example, a sheet feeding unit to feed a recording sheet to the conveyance belt 21 and a sheet output unit to output a sheet having an image formed by liquid droplets ejected from the recording head units 11.

While moving the carriage 4 in the main scanning direction X, the image forming apparatus 100 drives the recording head units 11 in response to image signals to eject ink droplets onto the sheet conveyed intermittently by the conveyance belt 21. After a first band of an image is recorded on the sheet 10, the sheet 10 is conveyed at a certain distance by the conveyance belt 21. Then, the next band of the image is recorded on the sheet 10 and the sheet 10 is conveyed at the certain distance. Such operation is repeated to form the full image and then the sheet with the image is outputted to an output tray.

Next, electrical components of the image forming apparatus according to the present exemplary embodiment are described.

The carriage 4 includes a head mount 4A, a carriage cover 4B, and a board mount 4C. The head holder 112 to hold the recording head units 11 is mounted on the head mount 4A. The board mount 4C on which a carriage circuit board 101 is mounted in a horizontal orientation (including substantially horizontal orientation) is disposed at an opposite end (a rear side in FIG. 2) of the head mount 4A in a sheet conveyance direction in which a sheet is conveyed by the conveyance belt 21. The carriage cover 4B is disposed above the head mount 4A and the board mount 4C to cover the head mount 4A and the board mount 4C. In this exemplary embodiment, the carriage cover 4B is a single member to cover both the head mount 4A and the board mount 4C. Alternatively, a plurality of covers may be provided to cover the head mount 4A and the board mount 4C individually.

The carriage circuit board 101 is a relay board to relay data transmission between a control circuit board 102 and each of a driver circuit (driver IC) to drive the recording head units 11, the encoder sensor 16 mounted on the carriage 4, or other sensors. The control circuit board 102 is equipped with a control circuit to control the image forming apparatus 100, for example, the conveyance and driving of the conveyance belt 21 and other components and the maintenance operation of the maintenance unit 41.

The board mount 4C has a mount face on which the carriage circuit board 101 is mounted and an opening 50 through which the encoder sensor 16 projects from the board mount 4C. By mounting the carriage circuit board 101 on the mount face, the encoder sensor 16 is set to a position at which the encoder sensor 16 can read the encoder scale 15.

The control circuit board 102 is disposed posterior to the carriage 4 in a horizontal orientation (including substantially horizontal orientation) at substantially the same level as the carriage circuit board 101.

The control circuit board 102 is connected to the carriage circuit board 101 via a flexible flat cable (hereinafter, FFC) 103.

The FFC 103 is connected to a connector 131 of the control circuit board 102 and a connector 135 of the carriage circuit board 101. The FFC 103 is led at a lead portion 103*c* from the connector 131 of the control circuit board 102 in the sheet conveyance direction Y (perpendicular to the main scanning direction X), is vertically extended downward at an upright portion 103*b*, is bent toward the sheet conveyance direction, and is folded at a folded portion 103*a* in the main scanning direction. Further, the FFC 103 is extended from the folded portion 103*c* in the main scanning direction below the board mount 4C, is bent back upward at a bent portion 103*d*, and is connected to the connector 135 of the carriage circuit board 101 through a cutout portion 51 of the board mount 4C.

At the cutout portion 51 of the board mount 4C, an upper side of the board mount 4C is cut out to extend the FFC 103 in the main scanning direction, thus allowing an operation to connect and remove the FFC 103 from the upper side of the carriage.

The carriage circuit board 101 is connected to each of the recording head units 11 via a connector 132, an FFC 134, and a connector 133.

Next, to illustrate one of the distinctive features and non-predictable effects of the invention according to this patent specification, maintenance work of the above-described carriage, control circuit board, and carriage circuit board in the present exemplary embodiment are described.

For example, the cover 19 illustrated in FIG. 1 is opened to expose the opening 20 so that an operator can access the control circuit board 102 through the opening 20. As a result, for example, the operator can remove the FFC 103 from the connector 131 or the control circuit board 102 from the image forming apparatus 100. The operator can also remove the carriage cover 4B to expose the carriage circuit board 101 and the head assembly 12, thus allowing maintenance work of the carriage circuit board 101 and the head assembly 12.

For example, in replacing the FFC 103, the operator can remove the FFC 103 from the connecter 135 and the connector 131 and release the folded portion 103*a* of the FFC 103 from a latching portion, not illustrated. Then the operator can pick the FFC 103 up from the opening 20 and install a new one according to a procedure opposite the above-described procedure. Thus, the installation and removal of the FFC 103 can be performed through the opening 20. Likewise, the removal and installation of the FFC 134 with respect to the connectors 132 and 133 can be performed through the opening 20.

In performing the maintenance work of the recording head units 11, the operator picks up the head assembly 12 from the opening 20. Then, the operator pulls a target one of the recording head units 11 from the head assembly 12 and performs maintenance work on the target one. After the maintenance, the operator mounts the recording head units 11 onto the head assembly 12 and mounts the head assembly 12 to the head mount 4A. Thus, the operator can mount and remove the head assembly 12 from the same direction as the direction from which he/she replaces the FFC 103.

For the maintenance work of the carriage circuit board 101, for example, when the encoder sensor 16 is stained, an operator can picks up the carriage circuit board 101 from the opening 20, cleans the encoder sensor 16, and mounts the carriage circuit board 101 onto the board mount 4C through the opening 20.

As described above, all the maintenance work can be performed through the opening 20, thus facilitating maintenance. In addition, for example, the operator can remove a sheet stopped on the conveyance belt 21 (for example, a jammed sheet of paper) through the opening 20. With such a configuration, the operator can access the interior of image forming apparatus 100 to perform different types of maintenance work from a common direction, thus shortening the work time of the operator and the downtime of the apparatus.

Figure 6:
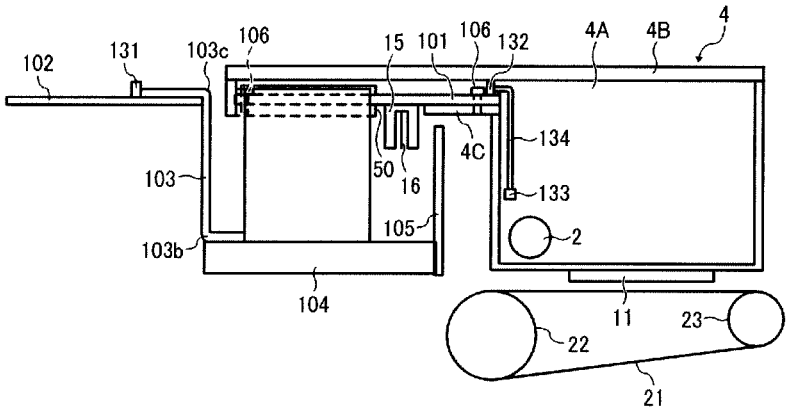
FIG. 6 is a side view of the carriage and the surrounding components illustrated to explain installation of a carriage control circuit.

Next, the mounting of the carriage circuit board 101 is described with reference to FIG. 6.

As described above, the carriage circuit board 101 is horizontally mounted on the board mount 4C of the carriage 4, thus allowing the carriage circuit board 101 to be fixed on the board mount 4C with fasteners 106, e.g., screws, from the upper side of the image forming apparatus 100.

Such a configuration can facilitate the mounting and removal of the carriage circuit board 101. If the carriage circuit board is disposed on the rear face of the carriage as in a conventional configuration, an operator needs to remove the carriage itself from the image forming apparatus in removing the carriage circuit board, thus reducing the workability. By contrast, in the present exemplary embodiment, the carriage circuit board 101 is horizontally disposed in the carriage, thus allowing the carriage circuit board 101 to be removed from and fixed on the carriage from the upper side of the image forming apparatus 100.

As described above, the carriage includes the board mount on which the carriage circuit board is horizontally mounted. The flexible flat cable is disposed below the board mount so as to be movable in the main scanning direction. The flexible flat cable is extended below the carriage circuit board, bent back toward the carriage circuit board, and connected to the carriage circuit board from the main scanning direction, thus facilitating maintenance.

Next, the effect of minimizing the occurrence of noise is described with reference to FIGS. 7 and 8.

Figure 7A:
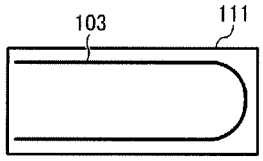
FIG. 7A is a schematic front view of a flexible flat cable (FFC) and a metal sheet constituting a portion of a structure (frame) of the image forming apparatus.
Figure 7B:
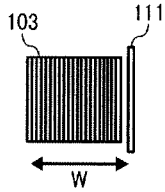
FIG. 7B is a schematic side view of the FFC and the metal sheet illustrated in FIG. 7A.
Figure 8A:
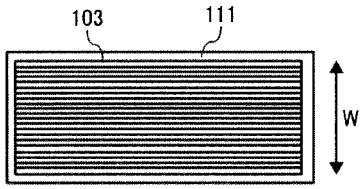
FIG. 8A is a schematic view of an FFC and a metal sheet according to a comparative example.
Figure 8B:
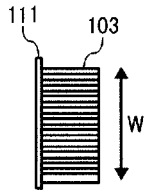
FIG. 8B is a schematic side view of the FFC and the metal sheet illustrated in FIG. 8A.

FIG. 7A is a schematic front view of the FFC and the metal sheet constituting the structure (frame) of the image forming apparatus in the present exemplary embodiment. FIG. 7B is a schematic side view of the FFC and the metal sheet illustrated in FIG. 7A. FIG. 8A is a schematic view of an FFC and a metal sheet according to a comparative example. FIG. 8B is a schematic side view of the FFC and the metal sheet illustrated in FIG. 8A.

The metal sheet 111 constituting the structure of the image forming apparatus 100 is vertically disposed. In the comparative example illustrated in FIGS. 8A and 8B, the FFC 103 is vertically disposed in the image forming apparatus 100 and face-to-face contacts the metal sheet 111 with movement of the carriage 4 (i.e., the FFC 103 contacts the metal sheet 111 so that the width direction W of the FFC 103 is parallel to a lateral face of the metal sheet 111). As a result, since noise tends to occur in the FFC 103, for example, a countermeasure such as a resin member between the FFC 103 and the metal sheet 111 may be required, thus increasing the cost.

By contrast, in the present exemplary embodiment, as illustrated in FIGS. 7A and 7B, the FFC 103 is horizontally oriented in the image forming apparatus 100 and line contacts the metal sheet 111 with movement of the carriage 4 (i.e., the FFC 103 contacts the metal sheet 111 so that the width direction W of the FFC 103 is perpendicular to a lateral face of the metal sheet 111). Such a configuration can reduce the occurrence of noise in the FFC 103 and omit the countermeasure component, thus reducing the cost.

Next, protection of the linear encoder from droplet mist due to ejection of ink droplets from the recording head units 11 is described with reference to FIG. 7.

Figure 9:
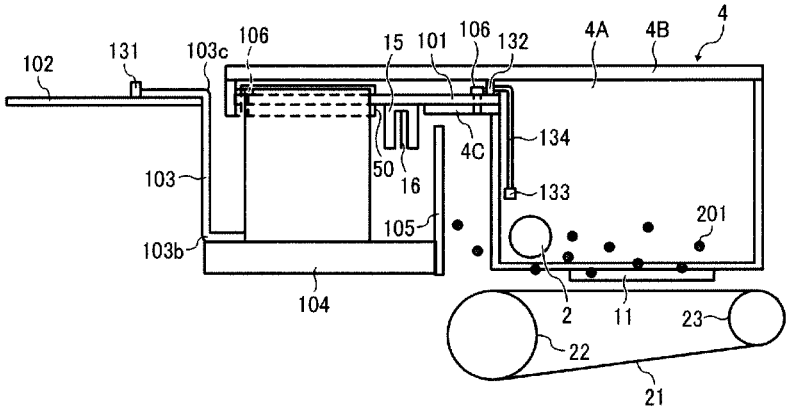
FIG. 9 is a side view of the carriage and surrounding components illustrating protection of a linear encoder from droplet mist generated by ejection of droplets.

As described above, the encoder sensor 16 is mounted on the carriage circuit board 101, and a stay (metal sheet) 105 constituting a structure of the image forming apparatus 100 to be mounted with the main scan motor 5 is provided between the encoder scale 15 and the head mount 4A of the carriage 4. With such a configuration, as illustrated in FIG. 9, even if mist 201 occurs due to ejection of droplets from the recording head units 11, the stay 105 acts as a partition to prevent the mist 201 from being scattered toward the encoder sensor 16 or the encoder scale 15, thus increasing the product life of the linear encoder.

Next, another exemplary embodiment is described with reference to FIG. 10.

Figure 10:
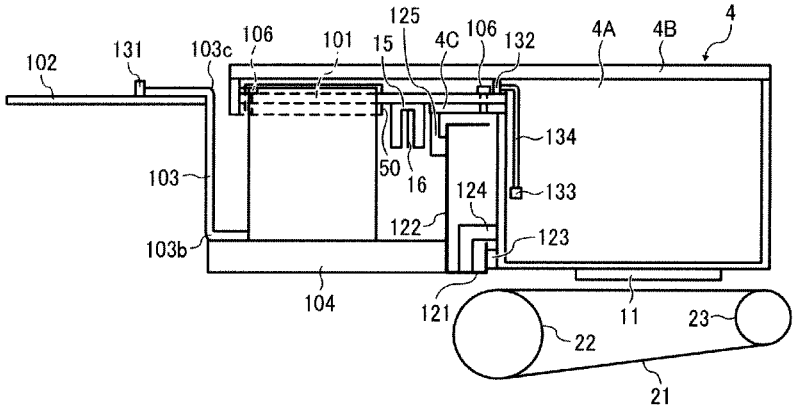
FIG. 10 is a schematic side view of a carriage and surrounding components of an image forming apparatus according to another exemplary embodiment.

FIG. 10 is a schematic side view of a carriage and surrounding components in the present exemplary embodiment. In the present exemplary embodiment, guide plates (carriage support guide members) 121 and 122 serves as guide members to guide movement of the carriage 4, and the carriage 4 includes contact portions (slide contact portions: guide portions) 123, 124, and 125 to slidingly contact the guide plates 121 and 122. The contact portion 123 defines the position of the carriage 4 with respect to the Y direction (sheet feed direction), the contact portion 124 defines the position of the carriage 4 with respect to the Z direction (height direction), and the contact portion 125 restricts the rotation of the carriage 4. As illustrated in FIG. 10, the guide plates are disposed between the recording head units 11 and the encoder scale 15. With such a configuration, even if mist occurs due to ejection of droplets from the recording head units 11, the guide plates 121 and 122 act as partitions to prevent the mist from being scattered toward the encoder sensor 16 or the encoder scale 15, thus increasing the product life of the linear encoder.

In the above-described exemplary embodiments, the image forming apparatus is described as a printer. However, it is to be noted that the image forming apparatus is not limited to such a printer and may be, for example, a multifunctional device having two or more capabilities of a printer, a facsimile machine, and a copier. In addition, the image forming apparatus may be an image forming apparatus using, for example, a recording liquid other than "ink" in strict meaning, fixing solution, or patterning material.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a housing;

a carriage mounted in the housing and reciprocally movable in a main scanning direction in the image forming apparatus;

a recording head mounted on the carriage to eject droplets;

a carriage circuit board mounted on the carriage and equipped with a circuit;

a control circuit board provided in the image forming apparatus and equipped with a control circuit;

a board mount provided in the carriage on which the carriage circuit board is horizontally disposed; and a flexible flat cable connecting the control circuit board and the carriage circuit board and movable in the main scanning direction below the board mount, the flexible flat cable extended below the carriage circuit board, bent back toward the carriage circuit board, and connected to the carriage circuit board from the main scanning direction, wherein the flexible flat cable comprises a lead portion connected to the control circuit board and leading from a connecting point at which the flexible flat cable is connected to the control circuit board in a direction perpendicular to the main scanning direction, an upright portion extended downward from the lead portion, and a folded portion including (a) a first section leading from the upright portion in the direction perpendicular to the main scanning direction and folded into (b) a second section leading in the main scanning direction, wherein the second section of the folded portion leading in the main scanning direction is disposed over an image formation region onto which the recording head ejects liquid droplets to form an image, and the second section is disposed at a position at which the board mount provided in the carriage passes an area above the second section, and wherein the housing includes an openable area that is openable and is disposed above a connecting point at which the flexible flat cable is connected to the carriage circuit board.

2. The image forming apparatus according to claim 1, further comprising a metal sheet vertically disposed in the image forming apparatus and forming part of a structure of the image forming apparatus, wherein the flexible flat cable is disposed horizontally against the metal sheet vertically disposed in the image forming apparatus.

3. The image forming apparatus according to claim 1, further comprising:

an encoder scale extending in the main scanning direction of the carriage;

an encoder sensor mounted on the carriage circuit board to read the encoder scale; and a partition disposed between the encoder sensor and the recording head.

4. The image forming apparatus according to claim 3, wherein the partition is a guide member to guide the carriage.

5. The image forming apparatus according to claim 4, wherein the carriage comprises:

a first contact portion to slidingly contact the guide member to define a position of the carriage in a direction perpendicular to the main scanning direction;

a second contact portion to slidingly contact the guide member to define a position of the carriage in a height direction of the carriage; and a third contact portion to slidingly contact the guide member to restrict rotation of the carriage.

6. The image forming apparatus according to claim 1, further comprising a fastener to fix the carriage circuit board on the carriage from an upper side of the carriage.

7. The image forming apparatus according to claim 1, wherein the control circuit board is disposed at a substantially same height as a height of the carriage circuit board.

8. The image forming apparatus according to claim 1, further comprising:

an openably closable cover disposed in an upper face of the image forming apparatus; and an opening at the upper face of the image forming apparatus, through which the carriage, the control circuit board, and the flexible flat cable are visible from an upper side of the image forming apparatus with the cover open.

9. The image forming apparatus according to claim 8, wherein the carriage further comprises a carriage cover to cover an upper side of the board mount and is removable upward from the image forming apparatus through the opening.

10. The image forming apparatus according to claim 1, further comprising:

an encoder scale extending in the main scanning direction of the carriage;

an encoder sensor disposed at a lower face of the carriage circuit board to read the encoder scale; and an opening provided in the board mount, through which the encoder sensor protrudes from the board mount.

11. The image forming apparatus according to claim 1, further comprising a cutout portion at one lateral side face of the carriage in the main scanning direction, through which the flexible flat cable is connected to the carriage circuit board.

12. The image forming apparatus according to claim 1, wherein the carriage include a head mount portion configured to amount a head holder to hold a plurality of recording heads, and the head mount portion is disposed on a same side of the carriage as the board mount on which the carriage circuit board is disposed.

13. The image forming apparatus according to claim 1 wherein the openable area of the housing comprises an opening portion and a cover to open and close the opening portion, both of the opening portion and the cover are disposed at an upper portion of the housing, and both of the connecting point at which the flexible flat cable is connected to the control circuit board and the connecting point at which the flexible flat cable is connected to the carriage circuit board are disposed within an opening of the opening portion.

* * * * *